US010004380B2

(12) United States Patent
Carlhoff et al.

(10) Patent No.: US 10,004,380 B2
(45) Date of Patent: Jun. 26, 2018

(54) OPTIMIZED DOSING PROCEDURE FOR A WASHING MACHINE

(75) Inventors: Gerold Carlhoff, Tonisvorst (DE); Andreas Ruppert, Siegsdorf (DE); Roger Swerts, Koersel (BE)

(73) Assignee: Ecolab USA Inc., Saint Paul, MN (US)

( * ) Notice: Subject to any disclaimer, the term of this patent is extended or adjusted under 35 U.S.C. 154(b) by 854 days.

(21) Appl. No.: 14/363,714

(22) PCT Filed: Dec. 14, 2011

(86) PCT No.: PCT/EP2011/072720

§ 371 (c)(1),
(2), (4) Date: Sep. 11, 2014

(87) PCT Pub. No.: WO2013/087100

PCT Pub. Date: Jun. 20, 2013

(65) Prior Publication Data

US 2015/0136179 A1 May 21, 2015

(51) Int. Cl.

| | |
|---|---|
| ***A47L 15/44*** | (2006.01) |
| ***A47L 15/00*** | (2006.01) |
| ***D06F 39/00*** | (2006.01) |

(52) U.S. Cl.

CPC ..... *A47L 15/4436* (2013.01); *A47L 15/0055* (2013.01); *D06F 39/004* (2013.01); *A47L 2401/023* (2013.01); *A47L 2501/07* (2013.01)

(58) Field of Classification Search

CPC ..... A47L 15/0055; A47L 15/4436; A47L 2401/023; A47L 2501/07; D06F 39/004

See application file for complete search history.

(56) References Cited

U.S. PATENT DOCUMENTS 5,500,050 A * 3/1996 Chan ..... A47L 15/0055 134/18
2007/0143934 A1* 6/2007 Potyrailo ..... D06F 39/004 8/158

FOREIGN PATENT DOCUMENTS

| | | |
|---|---|---|
| EP | 1886615 | 2/2008 |
| WO | WO 95/12704 | 5/1995 |

* cited by examiner

*Primary Examiner* — Katelyn B Whatley
(74) *Attorney, Agent, or Firm* — McKee, Voorhees & Sease, PLC

(57) ABSTRACT

The present invention relates to a method of controlling a dispenser for dosing a product in a washing machine leading to an optimized dosing result, a dispenser controller programmed with an algorithm to execute the method of the present invention as well as to the use of said dispenser for controlling dosing of a product in a washing machine.

12 Claims, 3 Drawing Sheets

OPTIMIZED DOSING PROCEDURE FOR A WASHING MACHINE

CROSS-REFERENCE TO RELATED APPLICATIONS

This application is the National Stage Entry of Application No. PCT/EP2011/072720, which has also been published as WO 2013/087100.

FIELD OF THE INVENTION

The present invention relates to a method of controlling a dispenser for dosing a product in a washing machine leading to an optimized dosing result, a dispenser controller programmed with an algorithm to execute the method of the present invention as well as to the use of said dispenser for controlling dosing of a product in a washing machine.

BACKGROUND OF THE INVENTION

In particular in institutional washing machines, including institutional laundry and in particular dishwashing machines, a product to be dispensed, e.g. a detergent, a conditioner, a rinse aid and the like, no unit dosages of said products are used. Rather single doses are obtained by dispensing a certain amount from a stock of said product contained in a reservoir inside the washing machine. Thus, in institutional washing machines, in particular in institutional dishwashing machines, there is a need to automatically control the dosing of these products into said washing machines from the reservoir which is connected to the rest of the washing machine, in particular the wash tank, by a reversibly closable output device, usually a valve. In institutional dishwashing machines usually large blocks or "bricks" of solid detergents, comprising a large number of single doses, are placed in such a reservoir and then are sprayed with water or diluted washing liquor from a spray nozzle to dissolve some of the detergent. To control the desired product concentration a dispenser controller usually is used in such washing machines controlling the product concentration in the washing machine by controlling dispensing of the product. Commonly, a sensor is located for example in the wash tank of such a washing machine measuring a parameter corresponding to the concentration of the product in the washing liquor present in said wash tank, which is coupled to the controller.

As already described in U.S. Pat. No. 5,500,050 such systems often suffer from the problem of controlling the product concentration closely about the desired setpoint with little over- or undershoot. Such under- or overshootings occur for example if a well soluble product is used (e.g. having a solubility in water having a temperature of 20° C. equal to or above 1 g/L, preferably of equal to or above 5 g/L), if the distance between the outlet of the product reservoir (the dosing point) and the sensor is rather large, as it is the case in many commercially available institutional single tank dishwashing machines or due to the decrease in feed rate over the lifetime of the product block or brick because of its decreasing size which leads to a larger distance between the spray nozzle and the block or brick. The dissolution and mixing time of the product in the washing liquor further is influenced by the temperature of both, the spray water and the washing liquor, the pressure at the spray nozzle, the intensity of mixing in the wash tank, the composition of the product and the like. It also should be borne in mind that a considerable amount of the product still maybe in the feed line connecting the dispenser to the wash tank when measuring the concentration in the wash tank.

Conventional washing machines use a simple control function which initiates dispensing of the product to the machine once the concentration in the wash tank drops below a given setpoint and do not stop dispensing until the sensor measures reaching of the setpoint. In consequence, the final concentration after dispensing typically is 50% or even more above the setpoint. This is undesirable from both, an economic as well as an ecologic point of view. In addition, due to the highly alkaline pH of detergents for institutional dishwashing machines, a constant overdosing also may result in severe glass corrosion. Too low a detergent concentration on the other hand leads to a poor cleaning result.

To eliminate at least some of these drawbacks, U.S. Pat. No. 5,500,050 describes a detergent dispenser controller which determines the detergent concentration in a dishwasher's water tank by measuring the conductivity therein and automatically learns the current feed rate of the detergent dispenser based on a moving average of then last feed cycles. In this way, large over- and undershootings due to the decrease of detergent block over time, for instance, may be minimized.

However, even using the method described in U.S. Pat. No. 5,500,050 over- and undershooting of product concentration still may be observed to an unfavourable extent. It was therefore an object of the present invention to provide a method of controlling a dispenser for dosing a product in a washing machine which allows to closely control the concentration of the product in a washing machine, but does not require any structural alterations with respect to mechanical parts of said washing machine.

This object is solved by the method of the present invention.

SUMMARY OF THE INVENTION

In contrast to any methods known from the state of the art, the method of the present invention takes into account the minimum opening time the reversibly closable output device of the dispenser, typically a solenoid valve, has to be opened in order to ensure proper release of the product to be dispensed.

In addition, the method of the present invention also takes into consideration the fact that in many single tank dishwashing machines for institutional applications the dosing point, i.e. the point at which a concentrated solution or dispersion is dispensed from the product reservoir into the washing machine, is located at a rather far distance from the sensor/the measuring means for measuring at least one parameter which corresponds to the concentration of the product in the solution.

Thus, the present invention provides a method of controlling a dispenser for dosing a product in a washing machine, said washing machine comprising:

(i) measuring means for measuring at least one parameter c* corresponding to the concentration of the product in a solution present in at least part of said washing machine, (ii) a dispenser to dispense said product, said dispenser being equipped with an reversibly closable output device having a minimum opening time tmin the dispenser has to be opened in order to ensure proper release of said product, (iii) a dispenser controller coupled to said measuring means and said dispenser, including at least one processor and at least one non-volatile memory for recording, calculating, controlling and/or storing process parameters, said method including steps of:

(a) after an initial mixing and/or waiting time, measuring said parameter c* to determine the current concentration of the product in the machine $c^*_{cur}$, (b) calculating the difference Δc* between a stored setpoint $c^*_{set}$ and the current concentration in the machine $c^*_{cur}$, (c) calculating and storing the current feed rate per minimum opening time $dc^*/t_{min}$ based on a moving average of the last n dispensing events, (d) if necessary, initiating dispensing of said product to said machine by opening said reversibly closable output device for a dosing time $t_{dos}$ resulting from the ratio of the difference between the setpoint and the current concentration Δc* to the current feed rate per minimum opening time $dc^*/t_{min}$, ($t_{dos}=\Delta c^*/(dc^*t_{min})$)

wherein dispensing only is initiated if $c^*_{cur}$ is either more than $x_1$ below the setpoint $c^*_{set}$($c^*_{cur}<(100\%-x_1)$ c*set) or in the range of from $(100\%-x_1)$ $c_{set}$ to below 100% $c^*_{set}$ and the sum of the current concentration and the increase in concentration ($c^*_{cur}+\Delta c^*/t_{min}$) does not exceed $(100\%+x_2)$ $c^*_{set}$, wherein $x_1$ is $0<x_1\leq 25\%$ and $X_2$ is $0<x_2\leq 40\%$.

The machine to be used in the method of the present invention furthermore may comprise a plurality of spraying nozzles, a spray pump and/or a circulating pump to spray and/or circulate water and/or the washing liquor in the machine.

The dispenser controller used in the method of the present invention does not only automatically adapt the feed rate based on a moving average of the last n dispensing events, but also calculates if an additional dispensing event would lead to an overdosing exceeding a pre-determined value $(100\%+x_2)$ $c^*_{set}$, taking into account the minimum opening time $t_{min}$ the reversibly closable output device of the dispenser has to be opened in order to ensure proper release of the product. Both the limit for undershooting $(100\%-x_1)$ $c^*_{set}$ as well as the limit for overshooting $(100\%+x_2)$ $c^*_{set}$ may be chosen according to the user's needs and may be stored in the non-volatile memory. If the current concentration $c^*_{cur}$ is more than $x_1$ below the setpoint, i.e. below the lower limit, dispensing is initiated in any case to avoid severe undershooting by opening the reversibly closeable output device for a dosing time $t_{dos}=/\Delta c^*/(dc^*/t_{min})$ However, if the current concentration is above the lower limit $(100\%-x_1)$ $c^*_{set}$, but below the setpoint $c^*_{set}$, the controller calculates if a dosing event lasting the minimum dosing time $t_{min}$ would lead to an increase in the concentration which exceeds the upper acceptable concentration limit $(100\%+x_2)$ $c^*_{set}$. If this is the case, dispensing is not initiated, since a small undershooting is considered to be more favorable than a large overshooting. If on the other hand, the calculated increase in concentration ($c^*_{cur}+\Delta c^*/t_{min}$) does not exceed the upper acceptable concentration limit $(100\%+x_2)$ $c^*_{set}$, dispensing is initiated by opening the reversible closable output device for the calculated dosing time $t_{dos}$.

As both the lower as well as the upper acceptable concentration limit may be chosen according to the user's needs, using the method of the present invention it is possible to optimize the dosing of a product in a washing machine in regard of the user's needs with respect to cleaning performance, economic as well as ecologic aspects, taking into account the machine's requirement without the need for any additional mechanical equipment or mechanical modifications of the machine.

The dispenser controller of the washing machine used in the present invention includes at least one processor and at least one non-volatile memory. Preferably, the dispenser controller includes a central processing unit (CPU), a random access memory (RAM), a read only memory (ROM) for storing the algorithm executed by the CPU and a non-volatile memory (e.g. a non-volatile random access memory, NVRAM) for storing parameters that control the dispenser's operation. As most of the commercially available washing machines comprise such a dispenser controller unit, the method of the present invention can be carried out on these washing machines without a need for mechanically modifying said machines.

As already explained above $x_1$ is in the range of from 0<x1 s 25%, including 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23% and 24% and $x_2$ is in the range of from $0<x_2\leq 40\%$, including 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38% and 39% corresponding to a lower acceptable concentration limit $(100\%-x_1)$ $c^*_{set}$ ranging of from 75% to >100% of the setpoint $c^*_{set}$, including 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98% and 99% and an upper acceptable concentration limit $(100\%+x_2)$ $c^*_{set}$ ranging of from >100% to ≤140% of the setpoint, including 101% 102%, 103%, 104%, 105%, 106%, 107%, 108%, 109%, 110%, 111%, 112%, 113%, 114%, 115%, 116%, 117%, 118%, 119%, 120%, 121%, 122%, 123%, 124%, 125%, 126%, 127%, 128%, 129%, 130%, 131%, 132%, 133%, 134%, 135%, 136%, 137%, 138% and 139%. Preferably, $x_1$ may be $0<x_1\leq 20\%$, more preferably $0<x_1\leq 15\%$ and even more preferably $0<x_1\leq 10\%$ and $x_2$ may be $0<x_2\leq 30\%$, more preferably $0<x_2\leq 20\%$ and even more preferably $0<x_2\leq 10\%$. Most preferably, both $x_1$ and $x_2$ represent 10%. The setpoint may be for example in the range of from 1 to 25 g product per liter of water, preferably of from 3 to g/L, more preferably about 2 g/L or the value of another parameter corresponding to said concentration such as for example a conductivity value.

The washing machine in which the method of the present invention is carried out preferably is a dishwashing machine. The method of the present invention may be carried out on both, continuously operated dishwashing machines, i.e. of the conveyor type, as well as in batch type dishwashing machines, including door type and hood dishwashers. Preferably said dishwasher may be an institutional dishwasher, either of the conveyor or the batch type. Preferably, the washing machine of the present invention is a single tank dishwashing machine, most preferably an institutional single tank dishwashing machine.

In both, conveyor as well as batch type institutional dishwashing machines after an optional prewashing step the tableware to be cleaned is first subjected to a flow of washing liquor for a time typically ranging of from about 45 to 90 s (main wash cycle) before being rinsed with water or a rinsing solution for about 10 to 30 s. The washing liquor used in the wash cycle typically is recycled and collected in the wash tank. In the next wash cycle, the used washing liquor is drawn from the wash tank by a pump and sprayed onto the next assembly of dishes through a plurality of nozzles.

In the rinsing cycle, a rinsing solution consisting of or formed from clear water is sprayed onto the dishes, then drains from the dishes and is collected in the wash tank as well, thereby leading to a dilution of the washing liquor. To ensure proper mixing in the wash tank before measuring the at least one parameter c* corresponding to the concentration of the product, every washing cycle includes an initial mixing and/or waiting time, during which neither measuring of parameters nor dispensing of product is carried out.

The parameter c* corresponding to the concentration of the product in a solution present in at least part of the washing machine in general may be any parameter corresponding to the concentration of the product in a reliable manner, including for example conductivity or pH of said solution. It is also possible to measure more than one parameter c* which corresponds to the concentration of the product, e.g. both, the conductivity as well as the pH. In addition, it is also possible to measure and/or monitor further parameters which may influence the correlation between said parameter c* and the concentration of the product, such as for example the temperature. Preferably, the at least one parameter corresponding to the concentration of the product is the conductivity of the washing liquor.

The kind of measuring means to be used for measuring said parameter depends on the parameter to be determined. If the conductivity of the solution is measured, said measuring means may for example represent at least one conductivity sensor, measuring the conductivity for example in S/m, mS/cm or μS/cm. Numerous commercially available dishwashing machines already comprise such a conductivity sensor which is well known to a person skilled in the art.

Having determined the current value for said parameter, it is possible to determine the current concentration of the product in the machine c*cur by comparing the experimentally determined value with a stored reference value. It should, however, be understood that in the method of the present invention it is not necessary to convert a value obtained for said parameter c* into a value for the concentration given in, for example, g/L, mg/ml or the like. Rather it is also possible to give a setpoint c*set of the same parameter experimentally determined, e.g. a conductivity setpoint given in, for example, μSiem, mS/cm or Sim, so that the experimentally obtained value for the parameter c* does not have to be converted into a concentration value given in a unit corresponding to mass per volume or the like.

The parameter corresponding to the concentration of the product preferably may be measured in the wash tank of the machine.

The minimum opening time $t_{min}$ of the reversibly closable output device is the time said device has to be opened in order to ensure proper, i.e. reproducible, release of said product from the dispenser to the washing machine, which preferably is at least 0.25 seconds (s), more preferably at least 0.5 s and even more preferably at least 1 s.

Said reversibly closable output device preferably comprises at least one valve, preferably at least one solenoid valve. A solenoid valve is an electromechanical valve, controlled by an electric current through a solenoid and may be directly driven, i.e. the solenoid acting directly on the main valve, or indirectly driven, i.e. a small solenoid valve, a so-called pilot, activating a larger valve. Typically indirectly driven solenoid valves, i.e. piloted valves are used in commercially available dispensers which have a minimum opening time $t_{min}$ of about 1 s.

In many commercially available washing machines the distance any liquid has to pass from said reversibly closable output device to said measuring means, i.e. the distance between the dosing point and said measuring means, is at least 20 cm, preferably less than 20 cm, more preferably less than 15 cm, most preferably less than 10 cm.

In combination with the minimum opening time $t_{min}$ of usually about 1 s, this may lead to a large overshooting of the product in conventional methods for dosing the product into these washing machines, in particular when well soluble products are used.

The number n of the last dispensing events used for calculating the moving average may be at least 3, preferably at least 5, more preferably at least 8 and most preferably at least 10.

When executing the method of the present invention for the first time, i.e. when no previous dispensing events have taken place yet, a stored reference feed rate (default value) may be used for this first washing cycle, e.g. of about 1 mS/cm per second.

The product to be dispensed in the method of the present invention preferably is a detergent, more preferably a dishwashing detergent. The method of the present invention is suitable to dispense liquid as well as solid dishwashing detergents, including gels, powders, bars, bricks, blocks, tablets, capsules, liquid concentrates and the like, without being limited to them.

Preferably the product of the present invention, however, is a solid dishwashing detergent, most preferably a dishwashing detergent in the form of a bar, a brick or a block.

Preferably, said detergent comprises at least one surfactant, preferably selected from the group consisting of non-ionic, anionic and amphoteric surfactants or mixtures thereof. Preferably, the suliactant comprises at least one non-ionic surfactant.

Furthermore, the product preferably may comprise one or more alkaline compounds, preferably selected from the croup comprising hydroxides, amides, ammonia, alkaline or earth alkaline metal oxides, silicates and the like.

The detergent may as well comprise one or more acids, including inorganic and/or organic acids or mixtures thereof, such as for example phosphoric acid, phosphonic acid, phosphorous acid, acetic acid, lactic acid and the like or salts thereof, without being limited to these.

The detergent furthermore may comprise complexing agents, including for example polycarboxylic acids such as polyacrylate, polymethacrylate, copolymers thereof, phosphates, or non-polymeric oligo- and polycarboxylates, such as for example nitrilotriacetic acid {NTA) or methylglycinediacetic acid (MGDA).

Furthermore, the detergent may comprise additional agents such as for example builders, corrosion inhibitors, foaming or defoaming agents, sanitizing and/or disinfecting agents, preservatives, enzymes, dyes, peliumes, corrosion inhibitors, optical brighteners and/or bleaching agents, without being limited to them.

A typical dishwashing detergent to be used as a product in the method of the present invention may, for example comprise about 15 to 25 weight percent (wt %) of a silicate such as sodium silicate Si02/Na02 1:1, about 1 to 5 wt % of an alkali hydroxide, such as for example sodium hydroxide, about 1 to 5 wt % of a nonionic suliactant, about 1 to 5 percent of a polymeric polycarboxylic acid, such as for example polyacrylate and about 30 to 50 wt % of a non-polymeric oligo- or polycarboxylic acid such as, for example NTA and a minor amount of up to 1 wt % of a defoaming agent, for example silicone/paraffine wax, the remainder being a solvent such as for example water.

The conductivity of the product in form of the use solution preferably may be in the range of from 2 to 10 mS/cm, when measured in a solution comprising 20 wt % of the product in water at a temperature of 25° C. Preferably, the conductivity is in the range of from 2 to 9 mS/cm, more preferably of from 3 to 8 mS/cm.

To ensure a proper mixing inside the wash tank, the method of the present invention preferably further comprises a step e) wherein no product is dispensed during an additional mixing and/or waiting time. Said additional mixing and/or waiting time in e) preferably may be followed by a further dispensing cycle comprising at least steps a) to d). During said additional mixing and/or waiting time in step e), preferably washing liquor may be sprayed onto the dishes. The action of a washing liquor circulating pump commonly used to draw the washing liquor from the wash tank to the spray nozzles usually agitates the liquor in said tank and thereby promotes proper mixing.

After elapsing of said additional mixing and/or waiting time a further dispensing cycle comprising at least the aforementioned steps a) to d) may be run.

One complete washing event may include two or more dispensing cycles, each of them comprising at least steps a) to d). The washing event may further comprise additional steps such as for example steps of rinsing and/or drying the dishes, without being limited to these. Possible steps to be carried out in commercially available washing machines are well known to a person skilled in the art. The complete washing event, including all possible steps, preferably lasts of from 25 s to 2 hours (h), preferably of from 30 s to 1 h, more preferably of from 35 s to 45 min, even more preferably of from 40 s to 30 min, even more preferably of from 45 s to 15 min and most preferably of from 1 min to 10 min.

The mixing and/or waiting time of each step a) and e) included in said washing event independently may last of from is to 5 min, preferably of from 2 s to 2 min and most preferably of from 3 s to 45 s.

Preferably, the initial mixing and/or waiting time after switching on the washing machine lasts of from about 1 s to about 10 s, while the additional mixing and/or waiting time during which the dish is preferably sprayed with washing liquor according to step e) preferably may last of from about 15 s to about 45 s.

The invention furthermore relates to a detergent dispenser controller suitable to be coupled to measuring means for measuring at least one parameter c*, corresponding to the concentration of a product in a solution present in at least a part of the washing machine, as well as to a dispenser, said dispenser controller including at least one processor and at least one non-volatile memory programmed with an algorithm to execute the method of the present invention as described above.

The present invention furthermore relates to a dishwashing machine comprising (i) measuring means for measuring at least one parameter c*, corresponding to the concentration of the product in a solution present in at least part of said washing machine, (ii) a dispenser to dispense said product, said dispenser being equipped with an reversibly closable output device having a minimum opening time $t_{min}$ the dispenser has to be opened, (iii) a dispenser controller as described above.

The machine to be used in the method of the present invention furthermore may comprise a plurality of spraying nozzles, a spray pump and/or a circulating pump to spray and/or circulate the washing liquor in the machine.

Preferably, said dishwashing machine is an institutional single tank dishwashing machine.

The present invention furthermore relates to the use of the dispenser controller according to the present invention to control a dispenser in a single tank dishwashing machine according to the method of the present invention.

EXAMPLES

Example 1: Comparison of Different Dosing Principles

A commercially available dispenser controller having a non-volatile random access memory (NVRAM) with a high number of read/write cycles suitable to be coupled to a conductivity sensor such as for example the commercially available dispenser controllers Ecodos or Ecoplus dispenser (Ecolab USA Inc.) were programmed and configured to carry out the following different methods of dosing a detergent (Solid Super Ultra, available from Ecolab USA Inc.) into a single tank dishwasher (Meiko DV40N):

1: Continuously suspending detergent until a detergent concentration equaling 80% of the concentration at the setpoint is detected by the conductivity sensor, afterwards dosing in a variable pulse/pause mode with a pulse period of 20 s. The setpoint was 3.8 mS/cm;

2: Continuously suspending detergent until a detergent concentration equaling 90% of the concentration at the setpoint is detected by the conductivity sensor, afterwards dosing in a variable pulse/pause mode with a pulse period of 10 s. The setpoint was 3.8 mS/cm;

3: The method of the present invention, using an upper limit of 110% c*set and a lower limit of 90% c*set (x1=X2=10%). The setpoint was 4 mS/cm.

Figure 1:
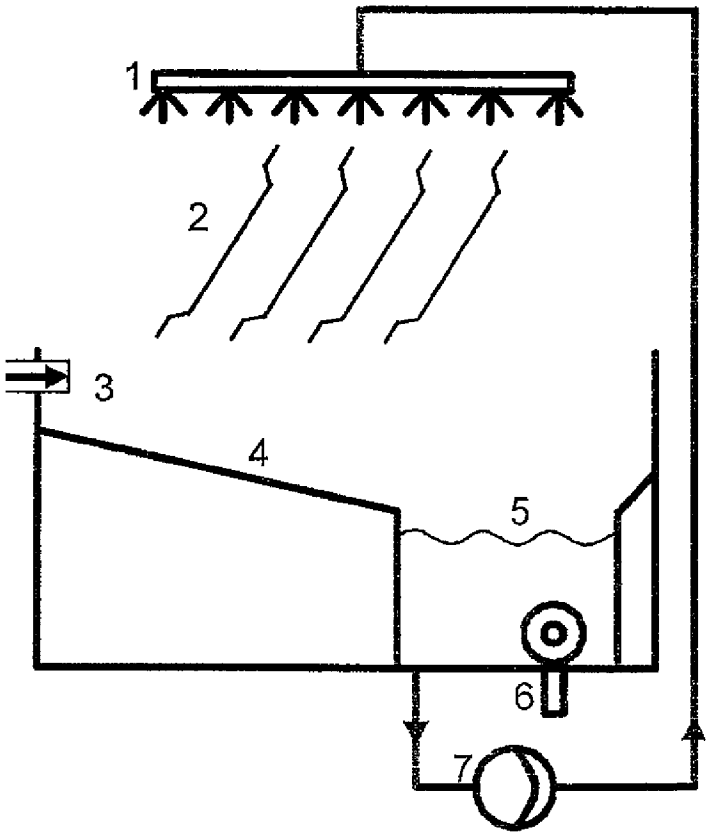
FIG. 1 shows a schematic view of an exemplary single tank dishwashing machine with a spray arm (1) comprising a plurality of nozzles, through which washing liquor can be sprayed onto the dishes (2). The used washing liquor draining from the dishes runs over a run-off plate (4) into a wash tank (5). The machine furthermore comprises a dispenser (3), from which the detergent product is dispensed into the dishwasher over the run-off plate (4) into the wash tank (5). At the bottom of the wash tank a sensor (6) is installed for measuring a parameter c*, corresponding to the concentration of the detergent product in the washing liquor, for example a conductivity sensor. A circulating pump (7) circulates the washing liquor from the wash tank (5) to the spray arm (1).
Figure 2:
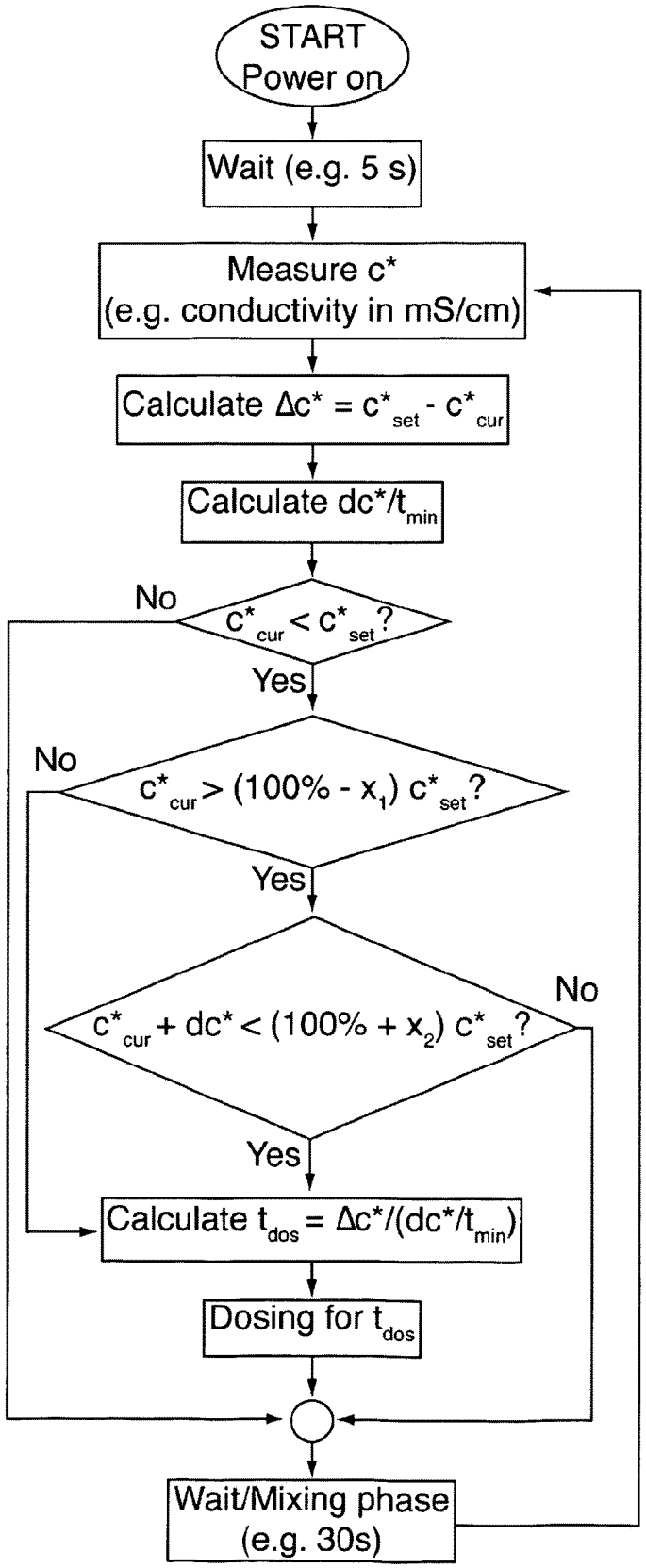
FIG. 2 is a flow chart illustrating the principle dosing algorithm the dispenser controller is programmed with in order to carry out the method of the present invention.
Figure 3:
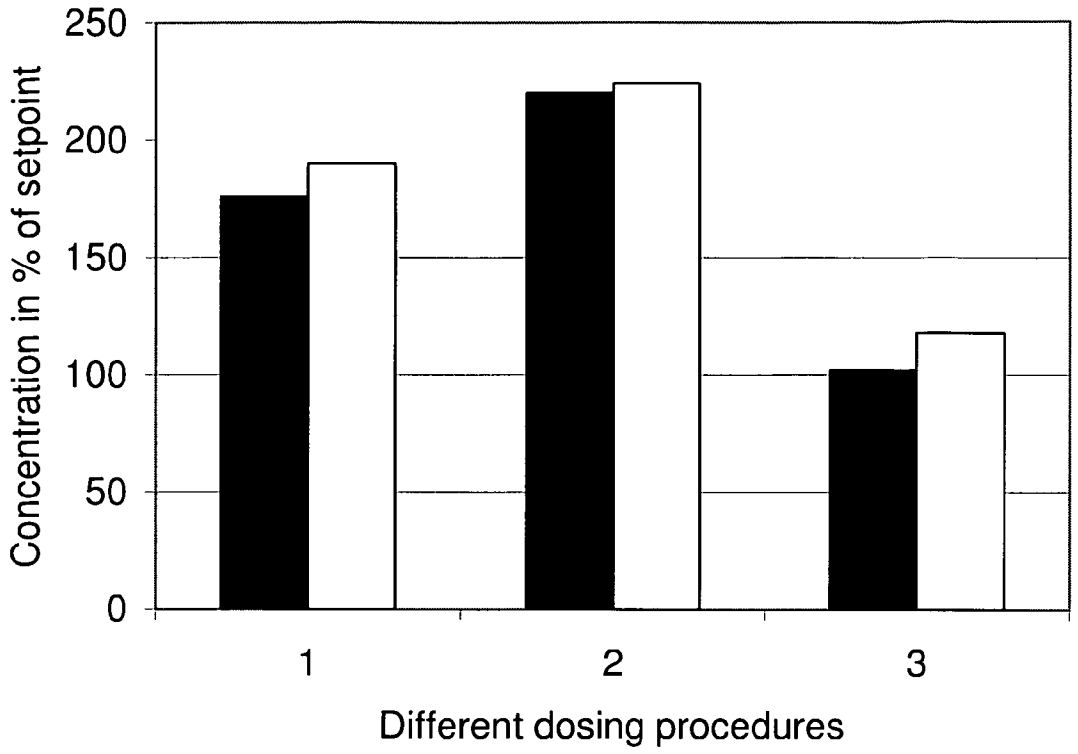
FIG. 3 shows a comparison of different dosing principles. Three different procedures were used to dispense detergent in a dishwasher. The final detergent concentration reached by each procedure is given relative to the setpoint. Each measurement was repeated two times, as shown by the black and white bars, respectively.

The results of these dosing procedures is depicted in FIG. 3. It can be seen that in particular during the first dispensing/measuring step, a large concentration overshoot is obtained using the methods known from the state of the art (items 1 and 2 on the left and in the middle of FIG. 3, respectively), while using the method of the present invention a concentration very close to the setpoint is already obtained in the first dispensing event and large overshooting is avoided even in the second dispensing event.

The invention claimed is:

1. A method of controlling a dispenser for dosing a detergent in a washing machine comprising:

(a) providing a washing machine comprising measuring means for measuring at least one parameter (c*) corresponding to the concentration of a detergent in a solution present in at least part of said washing machine, a dispenser to dispense said detergent, said dispenser being equipped with a reversibly closable output device having a minimum opening time ($t_{min}$) the dispenser has to be opened, and a dispenser controller coupled to said measuring means and said dispenser, including at least one processor and at least one non-volatile memory for recording, calculating, controlling and/or storing process parameters;

(b) measuring, after an initial mixing and/or waiting time, at least one said parameter (c*) to determine the current concentration of the detergent in the machine ($c^*_{cur}$);

(c) calculating the difference ($\Delta c^*$) between the setpoint ($c^*_{set}$) and the current concentration in the machine ($c^*_{cur}$);

(d) calculating and storing a current feed rate per minimum opening time ($dc^*/t_{min}$) based on an average feed rate per minimum opening time determined from a plurality of a number (n) of prior dispensing events;

(e) initiating dispensing of said detergent to said machine by opening said reversibly closable output devise for a dosing time ($t_{dos}$) resulting from the ratio ($\Delta c^*/(dc^*/t_{min})$) of the difference between the set point and the current concentration ($\Delta c^*$) to the current feed rate per minimum opening time ($dc^*/t_{min}$); and wherein dispensing is initiated if ($c^*_{cur}$) is more than $x_1$ below the setpoint ($c^*_{set}$); and wherein dispensing is initiated if ($c^*_{cur}$) is in the range of from ($100\%-x_1$) of the setpoint ($c^*_{set}$) to below 100% of the setpoint ($c^*_{set}$) and the sum ($c^*_{cur}+\Delta c^*$) of the current concentration ($c^*_{cur}$) and the difference between the setpoint and the current concentration ($\Delta c^*$) does not exceed ($100\%+x_2$) of the setpoint ($c^*_{set}$); and wherein $x_1$ is $0<x_1\leq 25\%$ and $x_2$ is $0<x_2\leq 40\%$; and wherein the minimum opening time ($t_{min}$) is from about 0.25 seconds (s) to about 1 second.

2. The method according to claim 1, wherein $x_1$ is $0<x_1\leq 20\%$, and $x_2$ is $0<x_2\leq 30\%$.

3. The method according to claim 1, wherein said washing machine comprises a, a single tank dishwashing machine, and/or an institutional single tank dishwashing machine.

4. The method according to claim 1, wherein the at least one parameter (c*) corresponding to the concentration of the detergent is the conductivity of the washing liquor.

5. The method according to claim 1, wherein the at least one parameter (c*) corresponding to the concentration of the detergent is measured in the wash tank of said machine.

6. The method according to claim 1, wherein said reversibly closable output device comprises at least one valve.

7. The method according to claim 6, wherein at least one valve is a solenoid valve.

8. The method according to claim 1, wherein the number (n) of the at least two of the last number (n) of dispensing events used for calculating the moving average is from 3 to 10.

9. The method according to claim 1, wherein the detergent comprises a liquid dishwashing detergent, and/or a solid dishwashing detergent in the form of a bar, a brick or a block.

10. The method according to claim 1, wherein the method further comprises a step (f) wherein no detergent is dispensed for an additional mixing and/or waiting time, and optionally followed by a further dispensing cycle comprising at least steps (a) to (e).

11. The method according to claim 1, wherein one complete washing event including all method steps lasts from about 25 seconds to about 2 hours (h).

12. The method according to claim 1, wherein the mixing and/or waiting time in step (b) independently lasts from about 1 second to 5 minutes.

* * * * *